US006286753B1

(12) United States Patent
Jackson et al.

(10) Patent No.: US 6,286,753 B1
(45) Date of Patent: Sep. 11, 2001

(54) DISPLAYABLE PRODUCE CONTAINER AND METHOD FOR MAKING THE SAME

(75) Inventors: Keith A. Jackson, Gurnee; James D. Southwell, Long Grove, both of IL (US)

(73) Assignee: Packaging Corporation of America, Lake Forest, IL (US)

( * ) Notice: Subject to any disclaimer, the term of this patent is extended or adjusted under 35 U.S.C. 154(b) by 0 days.

(21) Appl. No.: 09/693,477

(22) Filed: Oct. 20, 2000

Related U.S. Application Data

(60) Provisional application No. 60/161,105, filed on Oct. 22, 1999.

(51) Int. Cl.[7] ..... B65D 5/28; B65D 21/02

(52) U.S. Cl. ..... 229/174; 229/169; 229/915

(58) Field of Search ..... 229/167, 168, 229/169, 171, 174, 178, 915, 919

(56) References Cited

U.S. PATENT DOCUMENTS

| | | | | |
|---|---|---|---|---|
| 2,326,926 | * | 8/1943 | Bureau et al. | 229/171 |
| 3,201,025 | * | 8/1965 | Wolowicz et al. | 229/915 |
| 3,820,706 | | 6/1974 | Gibson et al. . | |
| 3,863,831 | | 2/1975 | Wozniacki et al. . | |
| 3,871,570 | | 3/1975 | Garmon . | |
| 3,887,126 | * | 6/1975 | Wilson | 229/171 |
| 3,910,484 | | 10/1975 | Wozniacki . | |
| 3,927,823 | * | 12/1975 | Persson | 229/171 |
| 3,940,053 | | 2/1976 | Putnam et al. . | |
| 4,053,098 | | 10/1977 | Baptist . | |
| 4,053,100 | | 10/1977 | Baptist . | |
| 4,082,215 | | 4/1978 | Eichenauer . | |
| 4,101,048 | | 7/1978 | Rieben et al. . | |
| 4,151,948 | | 5/1979 | de la Fuente, Jr. . | |
| 4,175,691 | | 11/1979 | Cornell et al. . | |
| 4,291,830 | | 9/1981 | Sorensen . | |
| 4,304,351 | | 12/1981 | Stollberg . | |
| 4,335,843 | | 6/1982 | Kent . | |
| 4,347,969 | | 9/1982 | Kost et al. . | |
| 4,349,147 | | 9/1982 | Jensen . | |
| 4,385,721 | | 5/1983 | Olsen et al. . | |
| 4,391,405 | | 7/1983 | Drinon . | |
| 4,418,863 | | 12/1983 | Kimbrell, Sr. . | |
| 4,537,344 | | 8/1985 | Thomas . | |
| 4,567,993 | | 2/1986 | Muise . | |
| 4,600,142 | | 7/1986 | Quaintance | 229/143 |
| 4,613,045 | | 9/1986 | Watson | 206/512 |
| 4,676,429 | | 6/1987 | Crowe et al. | 229/109 |
| 4,770,339 | | 9/1988 | Weimer | 229/143 |
| 4,883,221 | | 11/1989 | Brundage | 229/143 |
| 4,946,093 | | 8/1990 | Moorman . | |
| 5,000,377 | | 3/1991 | McClure | 229/154 |
| 5,002,224 | | 3/1991 | Muise | 229/169 |
| 5,052,615 | | 10/1991 | Edward et al. | 229/182 |
| 5,125,567 | | 6/1992 | McClure | 229/150 |
| 5,139,196 | | 8/1992 | Fry et al. | 229/157 |
| 5,163,609 | | 11/1992 | Muise, Jr. | 229/113 |

(List continued on next page.)

FOREIGN PATENT DOCUMENTS

| | | | | |
|---|---|---|---|---|
| 2682936 A1 | * | 4/1993 | (FR) | 229/174 |
| 2 728867A1 | | 12/1994 | (FR) . | |
| WO 99/43560 | | 9/1999 | (WO) . | |

*Primary Examiner*—Gary E. Elkins
(74) *Attorney, Agent, or Firm*—Jenkens & Gilchrist

(57) ABSTRACT

The present invention provides a stackable open-top container for use in shipping, storing and retail display of produce and other articles. The produce container of the present invention contains a bottom wall, two side walls, and two end walls. The concave ledges of the side walls contain curved scores. Each side wall contains two panels, each of which contains a mirrored curved score and two minor flaps. The curved scores cause the side walls to go into tension and create stacking shoulders for other containers. The minor flaps of the side walls surround the end walls to increase structural rigidity.

8 Claims, 5 Drawing Sheets

U.S. PATENT DOCUMENTS

| | | | |
|---|---|---|---|
| 5,261,594 | 11/1993 | Brown et al. | 229/191 |
| 5,285,956 | 2/1994 | Piepho | 229/191 |
| 5,289,970 | 3/1994 | McClure | 229/143 |
| 5,294,044 | 3/1994 | Clark | 229/191 |
| 5,330,094 | 7/1994 | Mertz | 229/167 |
| 5,361,975 | 11/1994 | Droste et al. | 229/120.34 |
| 5,361,976 | 11/1994 | Blomfield | 229/148 |
| 5,370,303 | 12/1994 | Fry | 229/143 |
| 5,392,985 | 2/1995 | Smith et al. | 229/125 |
| 5,429,296 * | 7/1995 | Southwell et al. | 229/919 |
| 5,516,034 | 5/1996 | Jensen et al. | 229/120 |
| 5,535,941 | 7/1996 | Garza | 229/191 |
| 5,649,663 | 7/1997 | Pestow, Jr. | 229/190 |
| 5,673,848 | 10/1997 | Garza | 229/191 |
| 5,687,902 | 11/1997 | Iusing et al. | 229/198.1 |
| 5,704,193 | 1/1998 | Roe et al. | 53/397 |
| 5,860,590 | 1/1999 | Blomfield et al. | 229/165 |

* cited by examiner

DISPLAYABLE PRODUCE CONTAINER AND METHOD FOR MAKING THE SAME

CROSS-REFERENCE TO RELATED APPLICATIONS

This application claims the benefit of U.S. provisional patent application Ser. No. 60/161,105, filed Oct. 22, 1999 and entitled "Displayable Produce Container And Method For Making The Same."

FIELD OF INVENTION

The present invention relates generally to containers for retaining, protecting and displaying articles and methods for making such containers. In particular, the present invention relates to a container having an open top formed from corrugated paperboard material and useful in shipping and displaying perishable produce.

BACKGROUND OF THE INVENTION

Flat sheets of corrugated paperboard, typically referred to as blanks, have been used for many years as the starting material to form produce containers. Corrugated paperboard generally refers to a multi-layer sheet material comprised of two sheets of liner bonded to a central corrugated layer of medium. Given a basic size requirement specified by the customer, industry standards, and the preference for low cost, paperboard container manufacturers strive to provide structural stacking strength with a minimal amount of corrugated paperboard. A typical well-known container is a single-piece tray design having a bottom wall, two side walls and two end walls each hinged to the bottom wall. Typically, a single piece of corrugated paperboard will be cut and scored to form a flat blank that will then be erected into this container.

Typical containers for the support and transport of food produce articles are corrugated containers having fixed configurations. These containers can be unstable when stacked and are conducive to toppling. Many containers are not durable and flexible enough to protect and prevent damage to the produce. Furthermore, the side and bottom walls of produce containers are susceptible to buckling and twisting, leading to damage to the produce.

A packed container of produce will generally hold a weight suitable for handling by an individual. Such containers will be generally rectangular and have a variable height dimension. Further, these containers will normally be stacked for transport and storage. The cost of labor, in the form of the time required to handle the produce and to assemble the shipping containers, can be significant factors in the overall cost of the produce. Many current produce containers can only be assembled by hand, a method that is costly and time consuming. Assembling paperboard containers for set-up by a machine where cooperating adjoining paperboard sections are adhesively bonded to form the produce container can reduce cost and time.

It is important in the production, distribution and sale of perishable and non-perishable articles such as produce that the articles are safely and conveniently stored for transport and safely and securely shipped for sale. Safe and secure storage and shipping is particularly a problem if heavy items must be placed in containers that are stacked upon each other. Stackable produce containers often acquire, for example, bulging side or end walls, deformed bottom walls or smashed corners that damage the produce due to, for example, the weight of or movement of the produce during shipment. Further, if the environment in which the paperboard container is shipped or stored is refrigerated, the moisture present in a refrigerated environment is likely to be absorbed by and weaken the container.

Once the produce reaches a retail destination, the produce container is normally placed directly on display for consumer sale. This allows retailers to preserve time and money by not having to transfer produce into an alternative selling container. If a produce container arrives to a retailer in a crushed or damaged state, however, the retailer usually cannot, for aesthetic purposes, exhibit the produce container. Furthermore, produce containers generally contain at least one or more visible panels that have not been painted or coated. Retailers that sell produce directly in the container that emanates from the grower usually do not, for aesthetic reasons, desire consumers to see unpainted or uncoated surfaces.

Vertically oriented corrugation fibers within a produce container are typically stronger and more secure than horizontally orientated fibers. Without structural rigidity, containers at or near the bottom of a stack of produce containers could buckle under the weight of the containers stacked above them. Generally, the end walls of a produce container contain vertically orientated corrugation fibers. Thus, it is preferable for the end walls to contain as few openings as possible. Optimal cooling efficiency, which enhances produce quality and shelf life, is also desirable. Cooling is achieved by including openings in each end wall to allow cool air flow from one end of the container to the other.

Accordingly, it is desirable to provide a container for transporting produce that is both durable and secure to prevent corrugation failure and produce damage, permits painting or coating or coating on all visible surfaces, yet allows sufficient air flow to achieve optimal cooling efficiency.

SUMMARY OF THE INVENTION

The present invention provides a stackable open-top container for use in shipping, storing and retail display of produce and other articles. The produce container of the present invention contains a bottom wall, two side walls, and two end walls. Each side wall contains two panels, each of which contains a mirrored curved score and two minor flaps. The curved scores cause the side walls to go into tension. The minor flaps of the side walls surround the end wall to increase structural rigidity

BRIEF DESCRIPTION OF THE DRAWINGS

The foregoing and other advantages of the invention will become apparent upon reading the detailed description as follows and upon reference to the drawings in which.

Figure 1:
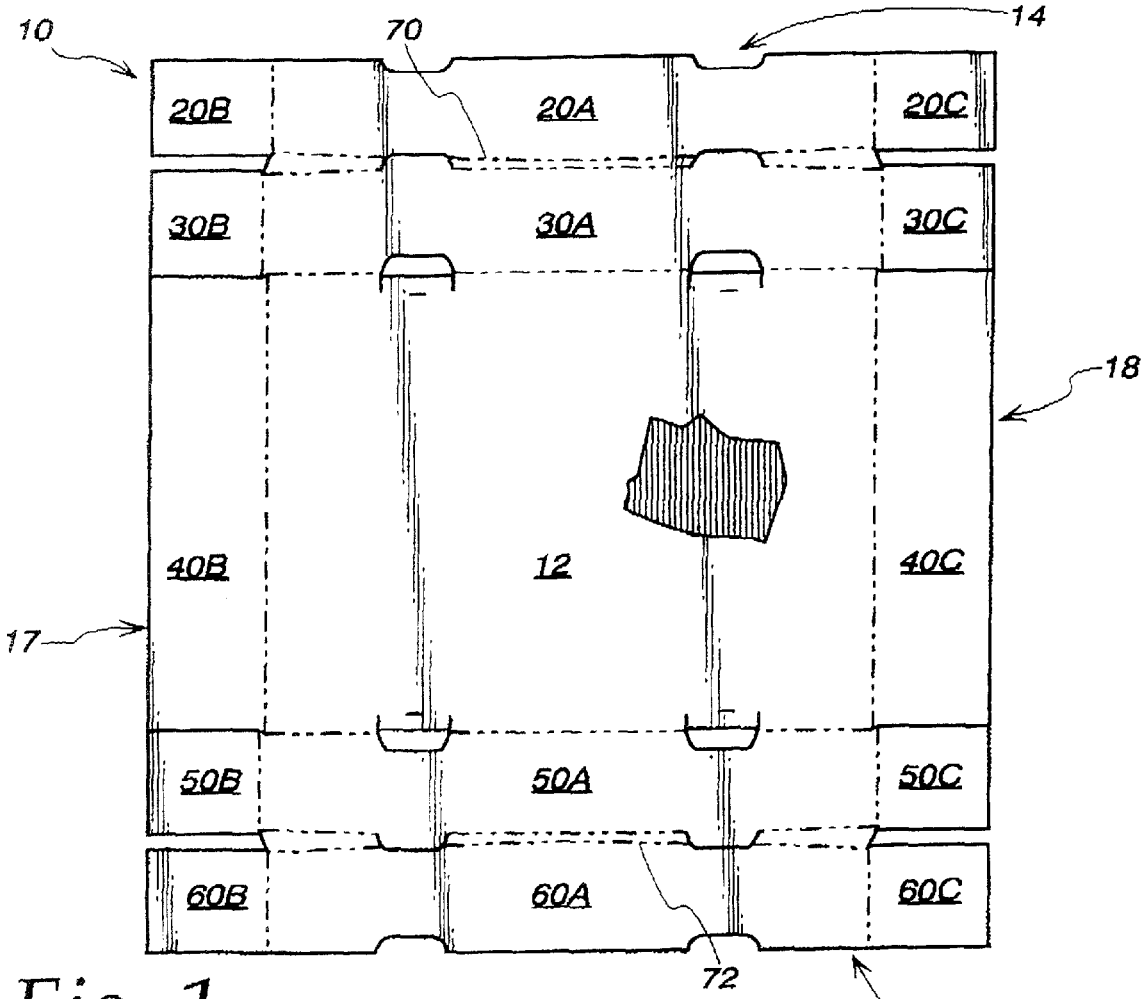
FIG. 1 is a plan view illustrating of a blank for forming the stackable produce container of the present invention.

While the present invention is susceptible to various modifications and alternative forms, two specific embodiments thereof have been shown by way of example in the drawings and will herein be described in detail. It should be understood, however, that it is not intended to limit the invention of the particular forms disclosed, but on the contrary, the intention is to cover all modifications, equivalents and alternatives falling within the spirit and scope of the invention as defined by the appended claims.

DESCRIPTION OF ILLUSTRATIVE EMBODIMENTS

Figure 8:
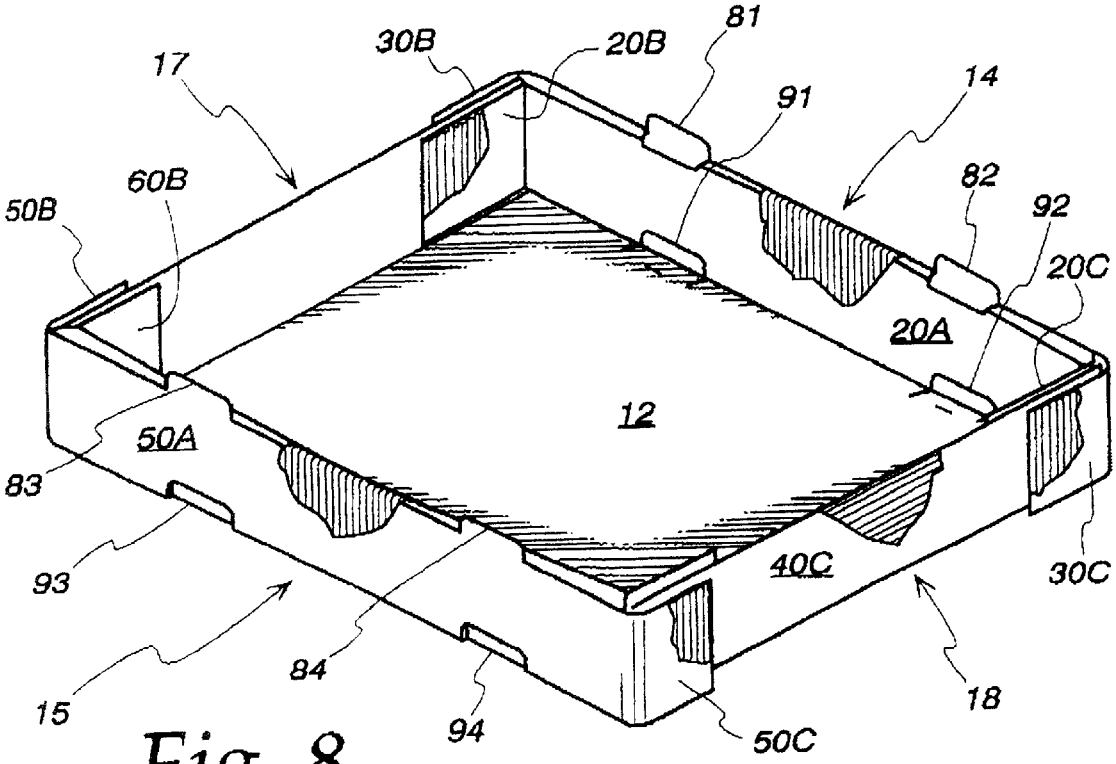
FIG. 8 is a perspective view of a stackable produce container including corrugation sketching embodying the present invention.

Turning now to the drawings, FIG. 1 shows a plan view of a blank for forming the stackable produce container 10 of the present invention. The produce container 10 is composed of a relatively rigid material such as corrugated board, solid fiberboard, heavy paperboard, or heavy plastic sheet. As illustrated in FIG. 8, the produce container 10 generally includes a bottom wall 12, a pair of vertically-corrugated side walls 14, 15, a pair of horizontally-corrugated end walls 17, 18, a plurality of vertically-corrugated minor inner side flaps 20B, 20C, 60B, 60C and a plurality of vertically-corrugated minor outer side flaps 30B, 30C, 50B, 50C.

To enhance the rigidity of the produce container 10, each side wall 14, 15 is formed from a pair of side panels and has a series of mirrored curves. In particular, the side wall 14 is formed from an outer side panel 30A and an inner side panel 20A hingedly connected to each other along opposed, concave curved scores that form the outer edges of a first upper transverse concave-shaped ledge 70 of the side wall 14. The outer side panel 30A is hingedly connected to the bottom wall 12. Similarly, the side wall 15 is formed from an inner side panel 60A and an outer side panel 50A hingedly connected to each other along opposed, concave curved scores that form the outer edges of a second upper transverse concave-shaped ledge 72 of the side wall 15. The outer side panel 50A is hingedly connected to the bottom wall 12.

When folded, the opposed, concave curved scores of the side panels cause the tension in the side walls to increase, thereby significantly improving the stacking strength of the produce container 10, reducing the possibility of damage or deformation to the produce container, and improving the overall structural rigidity of the produce container 10. Furthermore, the two side panels 20A, 30A are attached to each other at a central point or pinch point. A pinch point is the location at which the side panels connect or are closest to each other. Similarly, the two side panels 50A, 60A are attached to each other at a pinch point. It is contemplated in accordance with the present invention that the side panels can be adhered or laminated at the pinch point.

Figure 7:
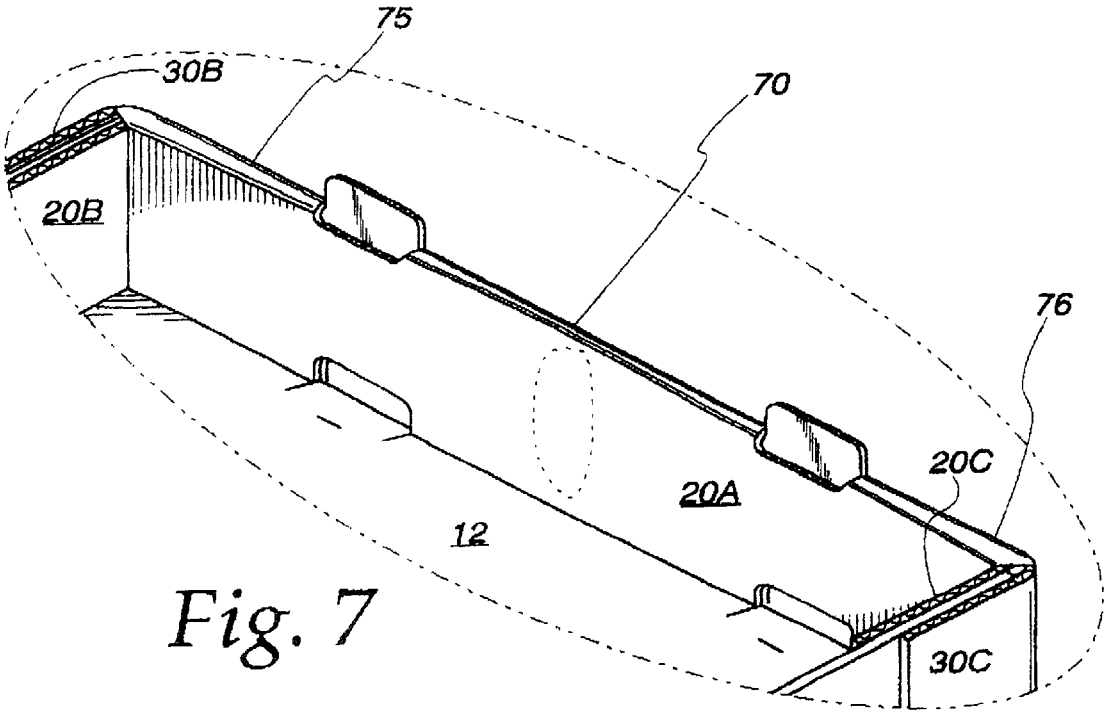
FIG. 7 is an enlarged portion of a portion of the produce container of FIG. 6.

Each ledge 70, 72, contains at least one shoulder area that provides structural rigidity and prevents nesting. FIG. 7 illustrates a ledge 70 with shoulders 75, 76 on opposing ends. Generally, the nesting problem has been addressed in previous produce containers by adding a corner structure and allowing a minor flap to swing out and form a corner post. This leaves an area in each corner unusable and produces an unsightly raw corrugated edge. The addition of shoulders to opposing ends of the ledges allows the use of the entire corner area and eliminates all raw corrugated edges.

Specifically, the concave-shaped ledges 70, 72 of the side walls 14, 15 contain wider stacking shoulder areas 75, 76, 77, 78 at opposing ends, as shown in FIG. 8. These stacking shoulders provide widened surface areas to support produce containers disposed above the produce container 10 of the present invention. The stacking shoulder areas 75, 76, 77, 78 substantially prevent nesting, which occurs when a box falls or "nests" into the open-top container below.

Figure 10:
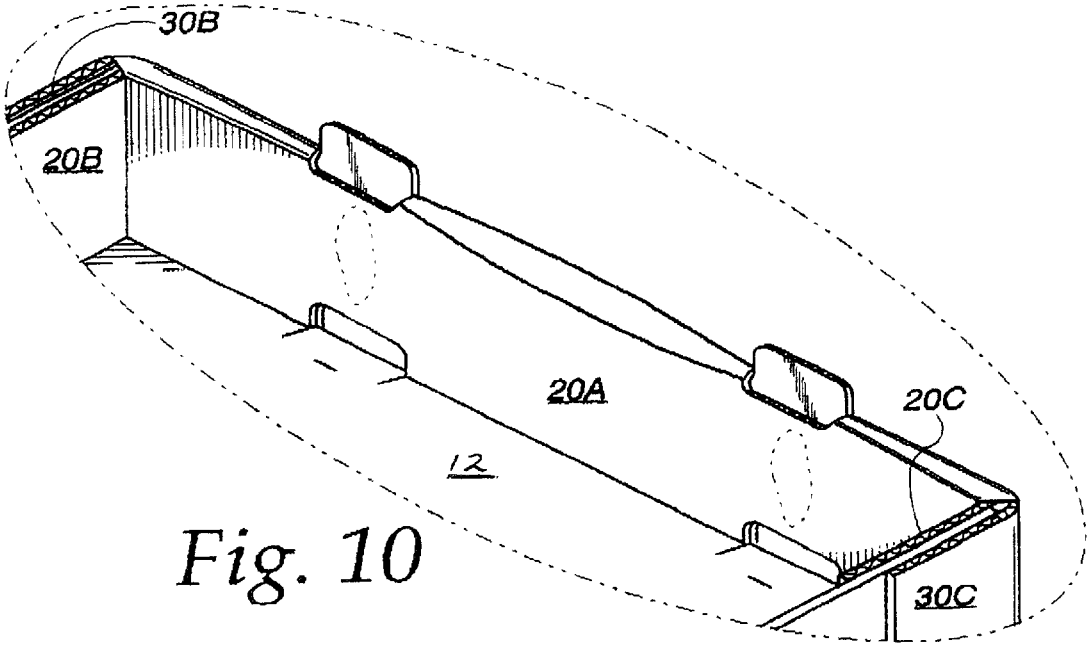
FIG. 10 is an enlarged portion of the produce container of FIG. 9.
Figure 9:
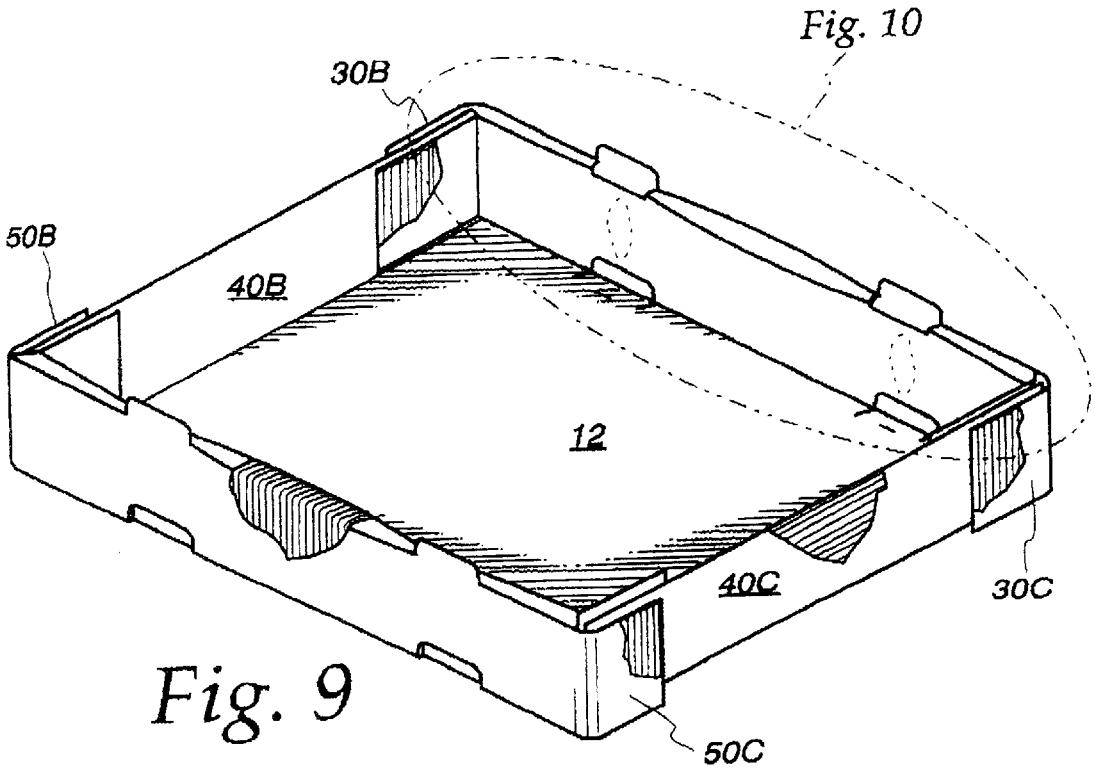
FIG. 9 is a perspective view of a stackable produce container of an alternative embodiment of the present invention.

As shown in FIGS. 9–10, an alternative embodiment of the produce container of the present invention possesses compound mirrored curves that produce widened areas not only at opposing ends of the ledges, but also in the central portion of the ledges. Two pinch points exist on the side walls of the alternative embodiment. Each pinch point is disposed at a location about under each stacking tab. A ledge containing a widened central portion provides for increased stability and strength for a stack of produce containers. Further, a widened central area allows the produce container to more securely support two overlying half-sized containers. A half-sized container will be sized such that two half-sized containers will be able to be seated perpendicular to and on top of a full-sized produce container immediately below. The end walls of the half-sized containers are disposed above the side wall ledges of the full-sized container below. One side wall of each half-sized container is disposed above an end wall edge of the full-sized container below. The other side wall of each half-sized container is disposed above the center of the full-sized container below. With the addition of the widened central area on each ledge of the underlying container, all four corners of the two half-sized containers will have an expanded stacking shoulder to rest upon, thus minimizing the risk that these containers will nest within the container below and increasing the stability and support of the entire stack of produce containers. In order for the half-sized container to properly be seated on the full-sized container below, the half-sized container must possess a single stacking tab and a single stacking receptacle, both located in the end wall of the half-sized container that is seated above the wall and ledge of the container below.

It is contemplated in accordance with the present invention that the side walls 14, 15, may be canted or pitched inward toward the center of the produce container in order to compensate for the width of the shoulders on the ledges 20E, 60E. If a stack of produce containers is jostled during shipment or incorrectly stacked so that individual containers get misaligned, the shoulders are sufficiently wide that one container stacked atop another will not tend to nest into the lower container. The size and shape of each of the shoulders maximize the openness of the container while virtually eliminating the possibility of nesting. The bowed inner side panels and the ledges also significantly improve the torsional and flexural rigidity of the produce container 10 due to the shape of the side panels and the thickness of the ledges, thereby improving the stacking strength of the produce container 10.

Another feature of the produce container 10 that significantly enhances its structural stability and stacking strength is that for each end wall, two minor inner side flaps extending from opposing ends of the inner side panels are adhered to the inside of the end walls and two minor outer side flaps extending from opposing ends of the outer side panels are adhered to the outside of the end walls. The three-layer structure of horizontally corrugated paperboard makes the end walls 17, 18 much more resistant than standard single-layer walls to bulging and to internal and external pressures that could cause the walls to buckle. Specifically, as illustrated in FIG. 9, minor inner side flaps

20B, 20C are hingedly connected to opposing ends of inner side panel 20A and are folded to attach to the inside of end panels 40B, 40C, respectively. Minor outer side flaps 30B, 30C are hingedly connected to opposing ends of outer side panel 30A and are attached to the outside of end panels 40B, 40C, respectively. Similarly, minor inner side flaps 60B, 60C are hingedly connected to opposing ends of inner side panel 60A and are folded to attach to the inside of end panels 40B, 40C, respectively. Minor outer side flaps 50B, 50C are hingedly connected to opposing ends of outer side panel 50A and are folded to attach to the outside of end panels 40B, 40C, respectively.

Thus, for each end wall, the minor outer side flaps and the minor inner side flaps and the end panel combine to yield an end wall possessing three layers of corrugated material, significantly enhancing the stability and strength of the produce container 10. FIG. 9 shows the minor end flaps 20B, 20C, 30B, 30C, 50B, 50C, 60B, 60C as extending only a portion of the length of the end panel 40C. It is contemplated, however, that each of the minor end flaps 20B, 20C, 30B, 30C, 50B, 50C, 60B, 60C could extend to the center of end panels 40B, 40C. The foregoing engagement of minor panels extending from the side panels of the produce container 10 improve the structural rigidity and stacking strength of the container by locking and supporting the side walls 14, 15 and end walls 17, 18 generally orthogonal to the bottom wall 12.

Figure 2:
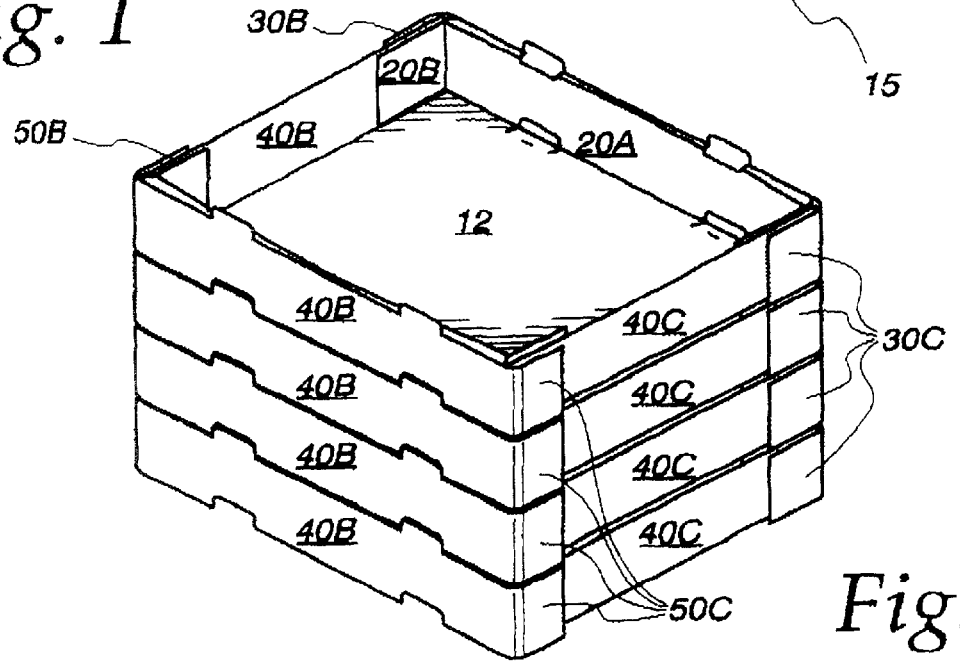
FIG. 2 illustrates several containers of the present invention stacked upon each other.

To permit stacking of several identical produce containers 10 (shown in FIG. 2) in a reliable, stable and balanced manner, the produce container 10 is provided with a plurality of stacking tabs and a plurality of stacking receptacles. In a preferred embodiment, two stacking tabs extend upwardly, as shown in FIG. 8, from the upper outer transverse edge 70 of the side wall 14. Similarly, two stacking tabs 83, 84 extend upwardly from the upper outer transverse edge 72 of the side wall 15. It is also contemplated in accordance with the present invention that two tabs can extend upwardly from the upper inner transverse edge of side walls 14 and 15. When an identical produce container is stacked on top of the produce container 10, the stacking tabs 81, 82, 83, 84 are received by stacking receptacles to the receptacles 91, 92, 93, 94 of the produce container 10.

Figure 3:
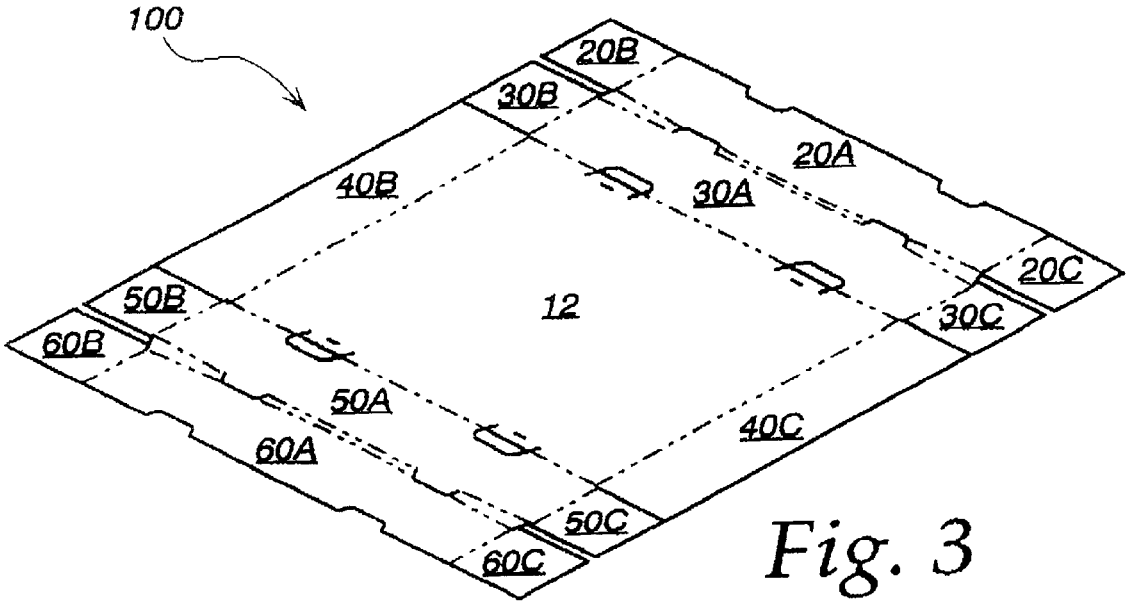
FIG. 3 is a perspective view of the flattened blank in FIG. 1 showing the die-cut use form the walls.

As shown in the perspective view of FIG. 3, the container blank 100 is in the form of a planar, unitary section of rigid material such as corrugated board, solid fiber board, heavy paperboard or heavy plastic sheet. With respect to the assembled produce container of FIG. 6, corresponding elements are indicated by the same reference numerals.

Figure 4:
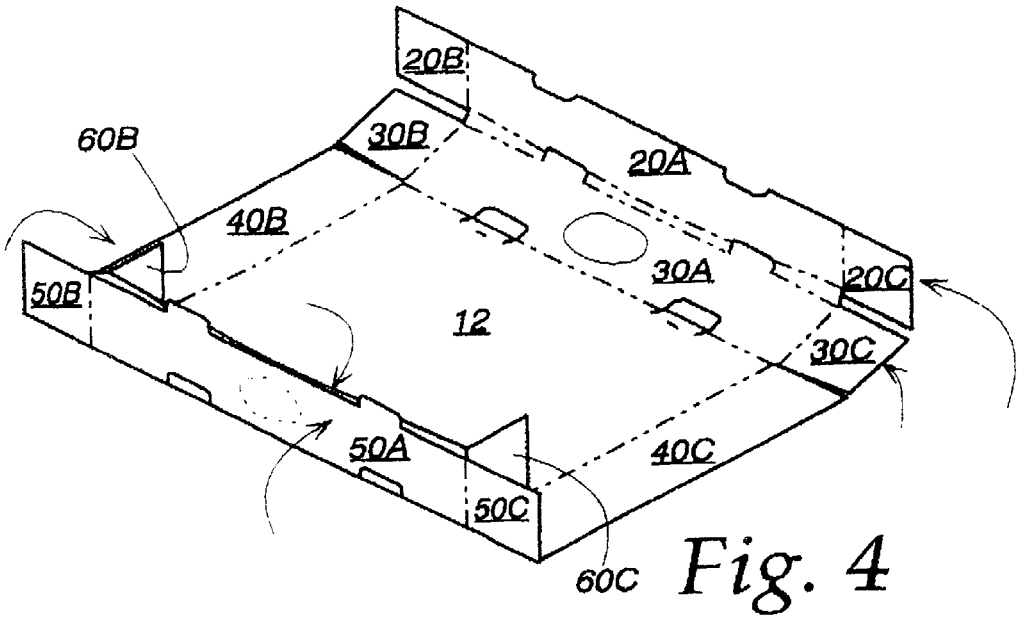
FIGS. 4 through 6 are top plan views showing the sequence of forming a stackable produce container embodying the present invention.

Using the sequence of folding steps detailed below and shown in FIGS. 4–6, the produce container 10 may be formed by hand or conventional tray-making equipment. First, as illustrated in FIG. 4, the outer side panels 30A, 50A are each rotated upward approximately 90 degrees relative to the bottom wall 12 so that the outer side panels are generally parallel to each other. Second, the inner side panels 20A, 60A are rotated over the top of and seated to the inside of the outer side panels 30A, 50A to form rigid, transverse ledges 70, 72. It is contemplated in accordance with one embodiment of the present invention that the inner side panels 20A, 60A could be adhered to the outer side panels 30A, 50A at a central location of the side panels.

Referring to FIG. 4, the minor inner side flaps 20B, 20C are hingedly connected to the inner side panel 20A and are each folded approximately 90 degrees relative to the inner side panel 20A such that the minor inner side flaps 20B, 20C are generally parallel. Similarly, minor inner side flaps 60B, 60C are hingedly connected to the inner side panel 60A and are each folded approximately 90 degrees relative to the inner side panel such that the minor inner side flaps 60B, 60C are generally parallel.

Figure 5:
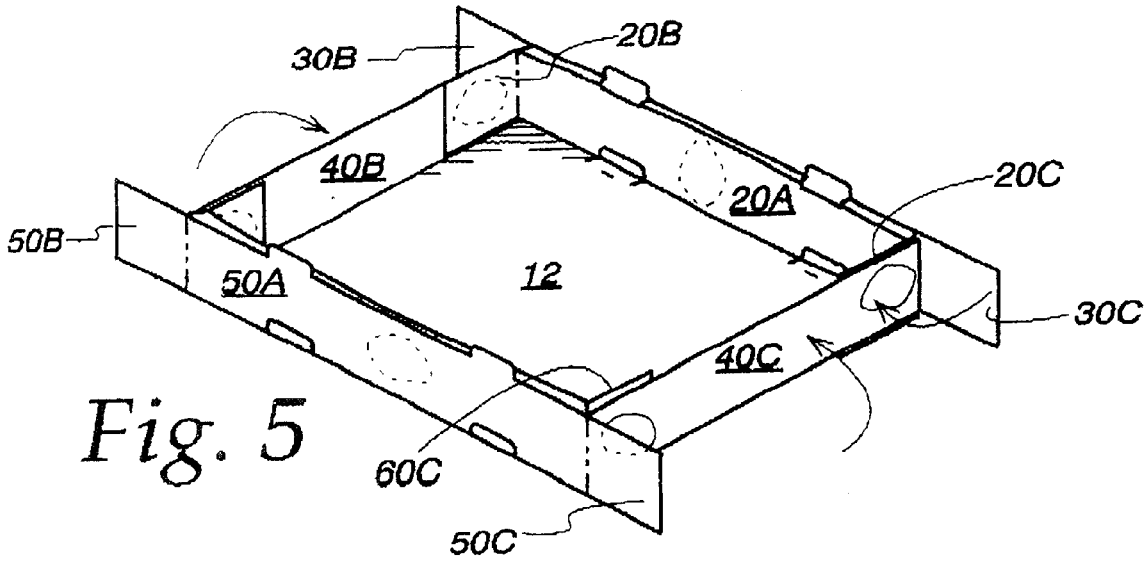
Figure 6:
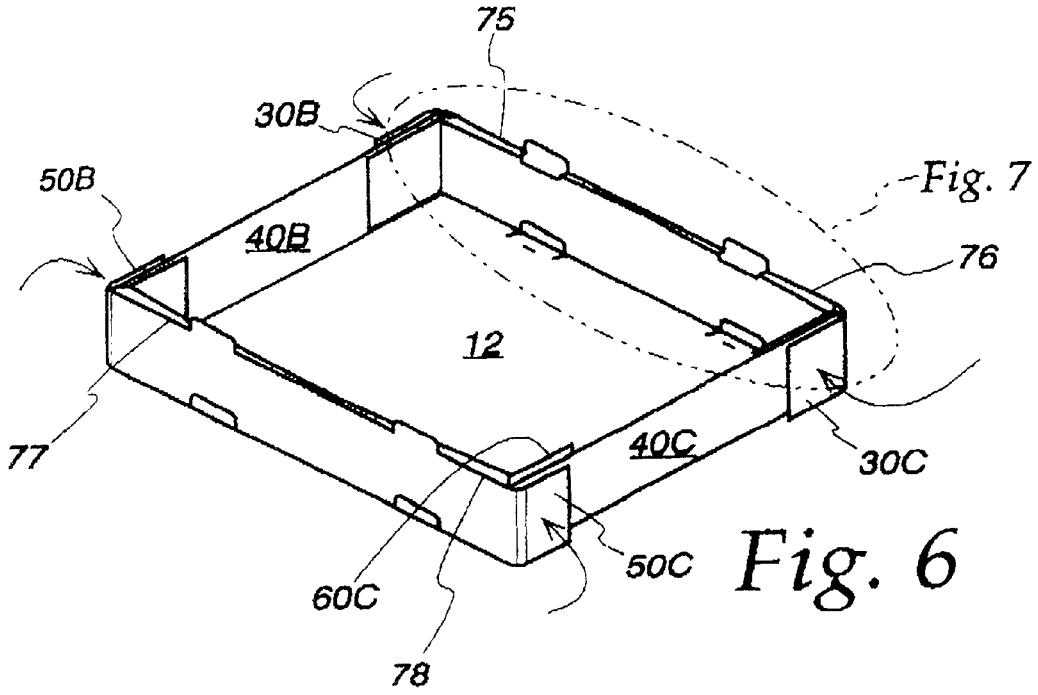

As shown in FIG. 5, end panels 40B, 40C are then folded upwardly approximately 90 degrees relative to the bottom wall 12 such that the end panels 40B, 40C are generally parallel and disposed on the outside of the minor inner side flaps 20B, 20C, 60B, 60C. Finally, minor outer side flaps 30B, 30C, 50B, 50C are each folded around the outside of end panels 40B, 40C. Specifically, minor outer side flaps 30B, 50B are hingedly connected to outer side panels 30A, 50A, and each are folded approximately 90 degrees such that minor outer side flaps 30B, 50B are disposed on opposing ends of end panel 40B. Similarly, minor outer side flaps 30C, 50C are hingedly connected to outer side panels 30A, 50A and each are rotated approximately 90 degrees such that the minor outer side flaps 30C, 50C are disposed on opposing ends of end panel 40C.

While the present invention has been described with reference to the particular embodiments illustrated, those skilled in the art will recognize that many changes and variations may be made thereto without departing from the spirit and scope of the present invention. The embodiments and obvious variations thereof are contemplated as falling within the scope and spirit of the claimed invention, which is set forth in the following claims.

What is claimed is:

1. A stackable produce container, comprising a bottom wall, first and second opposing side walls, first and second opposing end walls, each of said first and second side walls including an inner side panel and an outer side panel hingedly connected to each other along opposing concave scores to create a concave-shaped ledge, each of said inner side panels including a pair of minor inner side flaps hingedly connected to said inner panel, each of said outer side panels including a pair of minor outer side flaps hingedly connected to said outer panel, said end wall being captured between said minor inner side flaps and said minor outer side flaps.

2. The produce container of claim 1, wherein the opposing ends of said rigid ledge each contain a stacking shoulder.

3. The produce container of claim 1, wherein said opposing ends and the center area of said rigid ledge each contain a stacking shoulder.

4. The produce container of claim 1, wherein each of said inner side panels is attached to a respective said outer side panel at one or more pinch points.

5. The produce container of claim 1 further comprising a plurality of stacking tabs and a plurality of stacking receptacles.

6. The produce container of claim 5 further comprising at least one stacking tab extending upwardly from the upper edge of said inner side panel of said side wall.

7. The produce container of claim 1 further comprising at least one stacking tab extending upwardly from the upper edge of said outer side panel of said side wall.

8. A blank for forming a stackable produce container, comprising a central rectangular panel having a first pair of opposing edges and a second pair of opposing edges, a first outer side panel hingedly connected to one of said first pair of opposing edges, a second outer side panel hingedly connected to the other of said first pair of opposing edges, a first end panel hingedly connected to one of said second pair of opposing edges, a second end panel hingedly connected to the other of said second pair of opposing edges, a first inner side panel hingedly connected to said first outer side panel along a pair of curved score lines forming a first ledge, a second inner side panel hingedly connected to said second outer side panel along a pair of curved score lines forming a second ledge, a first pair of minor side flaps extending from opposing ends of said first inner side panel, a second pair of minor side flaps extending from opposing ends of said first outer side panel, a third pair of minor side flaps extending from opposing ends of said second inner side panel, and a fourth pair of minor side flaps extending from opposing ends of said second outer side panel.

* * * * *